United States Patent [19]

Kim et al.

[11] Patent Number: 5,074,136

[45] Date of Patent: Dec. 24, 1991

[54] MAGNETIC LOCK DEVICE

[76] Inventors: Young C. Kim, 207-304 Jugong Apt., Complex 2, Kaepo-Dong, Kangnam-Ku, Seoul; Young K. Kwak, 218-405 Shinshigaji Apt. Complex 2, Mok-Dong, Yangchun-Ku, Seoul, both of Rep. of Korea

[21] Appl. No.: 601,236

[22] Filed: Oct. 22, 1990

[30] Foreign Application Priority Data

Feb. 23, 1990 [KR] Rep. of Korea ..... 90-2003

[51] Int. Cl.[5] ..... E05B 47/00

[52] U.S. Cl. ..... 70/276; 70/413

[58] Field of Search ..... 70/276, 413

[56] References Cited

U.S. PATENT DOCUMENTS

| | | | |
|---|---|---|---|
| 1,172,203 | 2/1916 | Fuller | 70/413 |
| 3,518,855 | 7/1970 | Wake | 70/413 |
| 3,660,999 | 5/1972 | Janzen | 70/276 |
| 4,333,327 | 6/1982 | Wake | 70/413 X |

FOREIGN PATENT DOCUMENTS

| | | | |
|---|---|---|---|
| 0271587 | 10/1989 | Japan | 70/413 |
| 86-406 | 9/1986 | Rep. of Korea . | |
| 7604725 | 11/1977 | Netherlands | 70/276 |

*Primary Examiner*—Lloyd A. Gall

*Attorney, Agent, or Firm*—Birch, Stewart, Kolasch & Birch

[57] ABSTRACT

A lock device which includes a permanent magnetic key, a rotary circular cylinder having a key aperture, a plurality of main apertures which each contain a main locking pin with a main coil spring and permanent magnet, respectively, and a tubular cylinder having a plurality of auxiliary apertures for mating with the main apertures which contain an auxiliary locking pin with an auxiliary spring, respectively, whereby in a locked position, the auxiliary locking pins are located between the rotary circular and tubular cylinders, and in an unlocked position, when the permanent magnetic key is inserted into the key aperture, the auxiliary locking pins and the permanent magnets are moved to the tubular and rotary circular cylinders, respectively, so that the lock device is unlocked.

2 Claims, 3 Drawing Sheets

MAGNETIC LOCK DEVICE

BACKGROUND OF THE INVENTION

1. Field of the Invention

The present invention relates to an improved lock device and more particularly, to a lock device which includes a tubular cylinder and a rotary circular cylinder having a plurality of pin apertures, respectively, for receiving a plurality of locking pins which have both hollow portions disposed in both ends of the locking pins so as to receive a coil spring and a permanent magnet, whereby the locking pins are located between the tubular and rotary circular cylinders by biasing through the coil springs so as to lock the lock device and when a magnet key is inserted into a key hole, a plurality of raised portions of the key release the locking pins and permanent magnets for unlocking the lock device.

2. Description of the Prior Art

Various types of lock devices utilizing a permanent magnet are well known in the art. Korean Utility Model Publication 86-406 discloses one such lock device including a locking pin and a separate permanent magnet so that it is complicated in construction, difficult in use, and expensive to manufacture. Furthermore, such lock device can be unlocked by using a magnetic pin having a strong magnet and other tools.

SUMMARY OF THE INVENTION

Accordingly, it is an object of the present invention to provide an improved lock device utilizing a permanent magnet for overcoming the above problems of conventional lock devices.

Another object of the present invention is to provide a lock device including a tubular cylinder and a rotary circular cylinder having a plurality of pin apertures, respectively, for receiving a plurality of locking pins with both hollow portions disposed in both ends of each locking pin so as to receive a coil spring and a permanent magnet, whereby the locking pins are located between the tubular and circular cylinders by biasing the coil spring, in a locked position, and in an unlocked position, when a magnet key is inserted into a key hole, a plurality of raised portions of the key pushes the locking pins and the magnet key pulls the permanent magnets.

A further object of the present invention is to provide a lock device which is simple in construction, compact for portability, inexpensive to manufacture, durable in use, and refined in appearance.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a lock device which comprises a permanent magnetic key, a rotary circular cylinder having a key aperture, a plurality of main apertures which contain a main locking pin with a main coil spring and permanent magnet, respectively, a tubular cylinder having a plurality of auxiliary apertures for mating with the main apertures which contain an auxiliary locking pin with an auxiliary spring, respectively, whereby in a locked position, the auxiliary locking pins are located between the rotary circular and tubular cylinders, and in an unlocked position, when the permanent magnet key is inserted into the key aperture, the auxiliary locking pins and the permanent magnets are moved to the tubular and rotary circular cylinders, respectively, so that the lock device is released.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 3(*b*) is a sectional view of the key and locking member according to the present invention in unlocked position.

DESCRIPTION OF THE PREFERRED EMBODIMENTS

Figure 1:
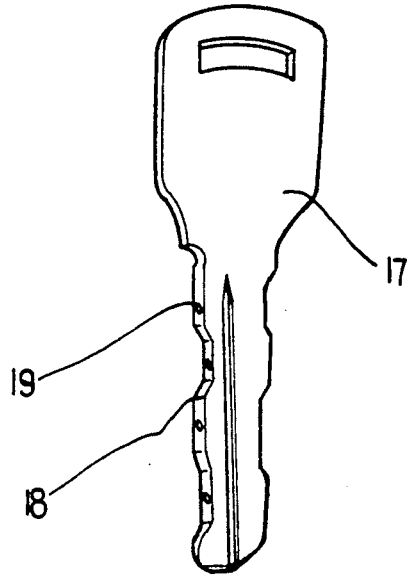
FIG. 1 is a perspective view of the lock device including a key and a locking member according to the present invention.
Figure 1:
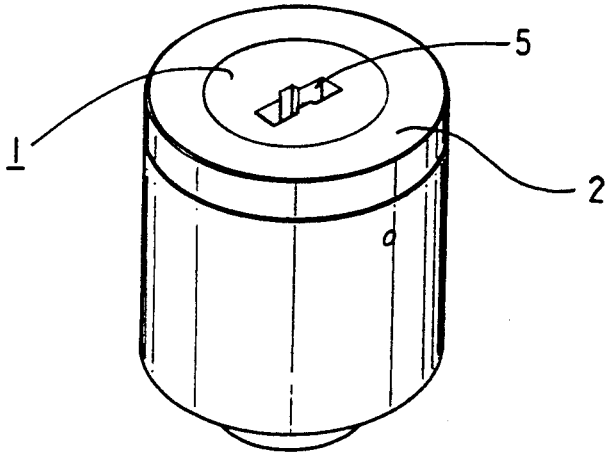
Figure 2:
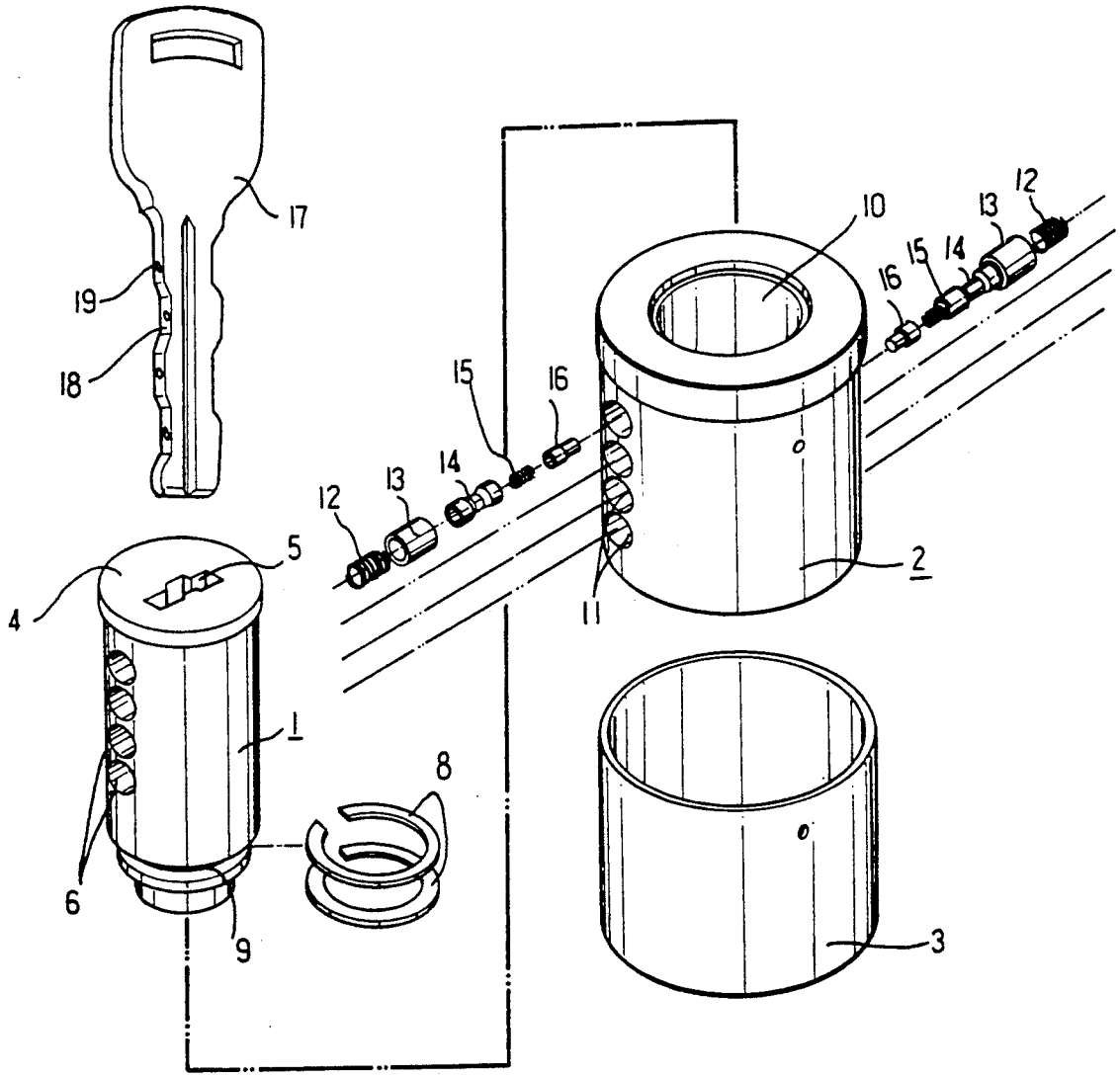
FIG. 2 is a exploded perspective view of the lock device according to the present invention.

Referring now in detail to the drawings for the purpose of illustrating preferred embodiments of the present invention, the lock device as shown in FIGS. 1 and 2, comprises a rotary circular cylinder 1, a tubular cylinder 2 for rotatively receiving the rotary circular cylinder 1, a casing 3 for housing the tubular cylinder 2, and a key 17.

Figure 3A:
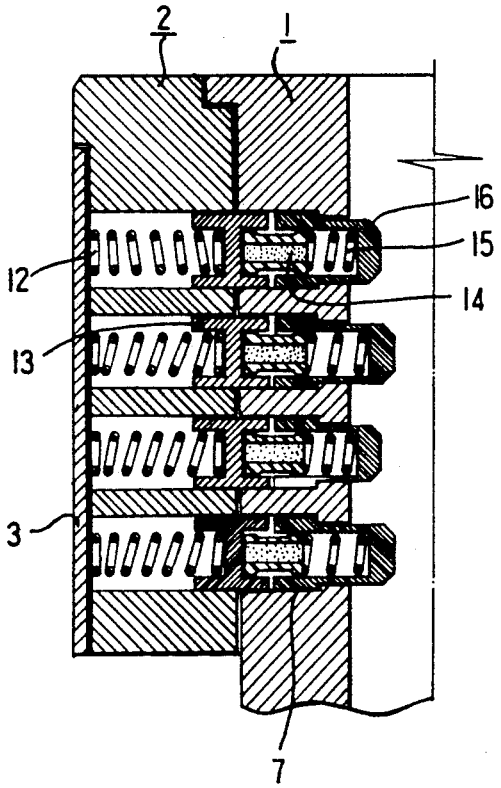
FIG. 3(*a*) is a sectional view of the locking member in locked position according to the present invention.
Figure 3B:
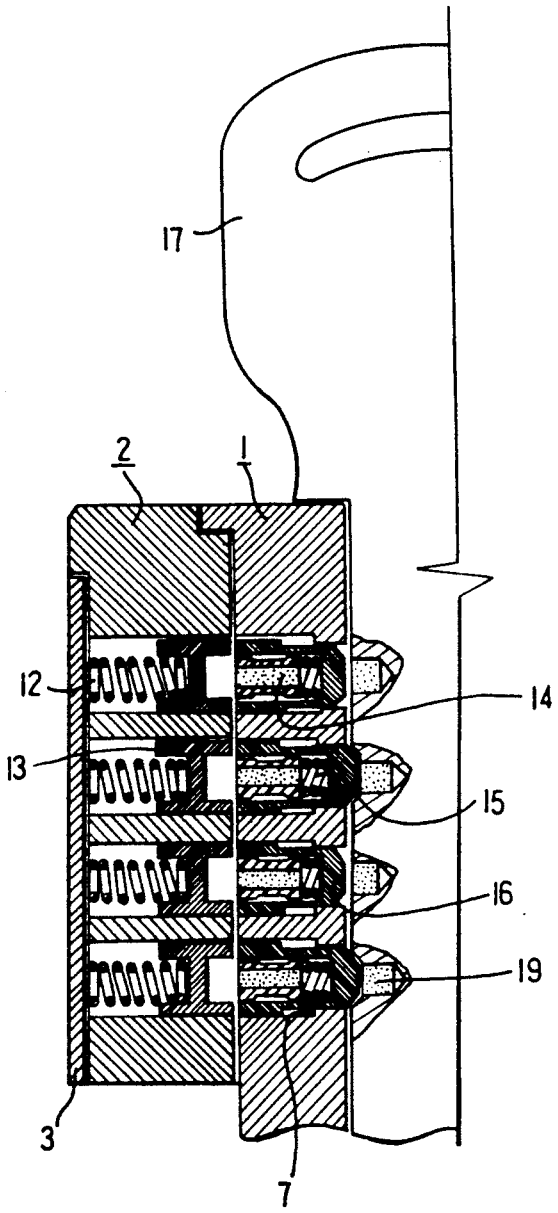

The rotary circular cylinder 1 includes a longitudinal key aperture 5 disposed on the top 4 thereof for smoothly receiving the key 17 and a plurality of horizontal pin extending apertures 6 disposed in both sides of the outer surface thereof forming a vertical line for communicating with the longitudinal key aperture 5, respectively. As shown in FIG. 3(*a*), each of the horizontal extending apertures 6 contains an auxiliary locking pin 16 having a protrusion for stopping through an inner raised portion 7 of extending aperture 6 as a stopper, respectively. The auxiliary locking pin 16 is hollow for containing an auxiliary coil spring 15 so as to retain a permanent magnet 14. Also, the rotary circular cylinder 1 is provided with an annular slot 9 disposed in the lower portion thereof for securing a fixing ring 8 so as to rotatively attach the rotary circular cylinder to the tubular cylinder 2. The auxiliary locking pins 16 are horizontally moved along the horizontal extending apertures 6, respectively. The permanent magnet 14 is covered with a insulating material.

The tubular cylinder 2 has a longitudinal hole 10 for rotatively receiving the rotary circular cylinder 1. The tubular cylinder 2 includes a plurality of horizontal pin apertures 11 disposed in both sides thereof formed in a vertical line for communicating with the plurality of pin extending aperture 6, respectively. As shown in FIGS. 2 and 3(*a*), the each of pin apertures 11 is provided with a H-shaped main locking pin 13 movably disposed therewithin, the main locking pin 13 having both hollow portions disposed in both ends thereof for containing a main coil spring 12 and the permanent magnet 14, respectively. That is, the permanent magnet member 14 is located between the H-shaped main locking pin 13 and a hollow auxiliary coil spring 15 in the auxiliary locking pin 6. The main locking pin 13 are horizontally moved along the horizontal pin apertures 11, respectively. Also the tubular cylinder 2 is inserted into the casing 3.

The key 17 includes a plurality of recesses 18 and a plurality of key permanent magnets 19 built in both sides thereof, which mate with the permanent magnets 14 disposed in the pin extending apertures 11. The poles of the permanent magnets 14 and 19 are opposite so as to attract each other.

The lock device according to the present invention operates as follows.

As shown in FIG. 3(*a*) in a locked position, the H-shaped main lock pins 13 are located between the rotary circular cylinder 1 and the tubular cylinder 2 after the pin apertures 6 communicate with pin extending apertures 11, respectively. At this time, the H-shaped locking pins 13 are biased by the main coil springs 12 and the auxiliary coil springs 15 through the permanent magnet 14.

As shown in FIG. 3(*b*), in an unlocked position, when the key 17 is inserted into the key aperture 5, the plurality of recesses 18 of the key 17 push ends of the auxiliary locking pins 16 and compress the main and auxiliary springs 12 and 15 and the key permanent magnets 19 simultaneously attract the auxiliary locking pins 16 since the poles of both magnets 14 and 19 are opposite of each other and the auxiliary coil springs 15 are biased so that the rotary circular cylinder 1 is separated from the tubular cylinder 1. Therefore, since the rotary circular cylinder 2 can be rotated by itself, the lock device is easily released. If the key 17 is not fully inserted into the key aperture 5 of the rotary circular cylinder 1, since the pole of the permanent magnet 14 is opposite that of the key permanent and the permanent magnets 14 and 19 attract each other, the permanent magnets 14 are located between the rotary circular cylinder 1 and the tubular cylinder 2 so that the lock device does not release.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A lock device comprising:

a key having a plurality of recesses and a plurality of key permanent magnets built in one side thereof, a rotary circular cylinder having a key aperture for receiving the key and a plurality of first horizontal apertures, having an annular stopper in the vicinity of the center thereof, disposed in both sides of the outer surface of said rotary circular cylinder and communicating with said key aperture, said rotary circular cylinder being provided with an annular slot disposed therein for receiving a fixing ring;

a plurality of first hollow locking pins disposed within said first horizontal apertures, each of said first locking pins containing a first coil spring, a first lock permanent magnet biased by said first coil spring disposed therewithin, and a raised portion for being stopped by said annular stopper, a tubular cylinder having a longitudinal hole disposed in the center thereof for receiving said rotary circular cylinder, said tubular cylinder including a plurality of second horizontal apertures and corresponding to said plurality of first horizontal apertures, a plurality of second H-shaped locking pins disposed within said second horizontal apertures, each of said H-shaped second locking pins containing hollow portions disposed at both ends thereof for receiving a second coil spring and said lock permanent magnet, respectively, and a casing receiving said tubular cylinder with said rotary circular cylinder, whereby in a locked position, the H-shaped second locking pins are located between the rotary circular cylinder and the tubular cylinder and, in an unlocked position, when the key is inserted into the key aperture, since the plurality of recesses of the key push the plurality of first locking pins, the H-shaped second locking pins are moved to the tubular cylinder and the lock permanent magnets are moved to the rotary circular cylinder by the magnetic power of the key so that the rotary circular cylinder can be rotated thereby releasing the lock device.

2. The lock device of claim 1, wherein the lock permanent magnets have magnetic poles opposite that of the key permanent magnets for releasing the lock device when the key is fully inserted into the key aperture.

* * * * *